United States Patent [19]

Yan et al.

[11] Patent Number: 4,522,703

[45] Date of Patent: Jun. 11, 1985

[54] THERMAL TREATMENT OF HEAVY HYDROCARBON OIL

[75] Inventors: Tsoung Y. Yan, Philadelphia, Pa.; Nai Y. Chen, Titusville, N.J.

[73] Assignee: Mobil Oil Corporation, New York, N.Y.

[21] Appl. No.: 554,013

[22] Filed: Nov. 21, 1983

Related U.S. Application Data

[63] Continuation-in-part of Ser. No. 281,159, Jul. 8, 1981, abandoned.

[51] Int. Cl.[3] ..... C10C 3/00; C10G 9/14

[52] U.S. Cl. ..... 208/106; 208/40

[58] Field of Search ..... 208/106, 126, 40, 131

[56] References Cited

U.S. PATENT DOCUMENTS

| | | | |
|---|---|---|---|
| 2,358,573 | 9/1944 | Hemminger et al. | 208/126 |
| 2,476,729 | 7/1949 | Helmers | 208/106 |
| 2,695,264 | 11/1954 | Taff et al. | 208/106 |
| 2,733,192 | 1/1956 | Sage | 208/106 |
| 2,850,436 | 9/1958 | Beuther et al. | 208/40 |
| 3,065,165 | 11/1962 | Amis et al. | 208/106 |
| 3,928,170 | 12/1975 | Takahashi et al. | 208/40 |
| 4,014,781 | 3/1977 | Ueda | 208/40 |
| 4,049,538 | 9/1977 | Hayashi et al. | 208/131 X |
| 4,072,599 | 2/1978 | Bullough et al. | 208/40 |
| 4,302,324 | 11/1981 | Chen et al. | 208/131 |

*Primary Examiner*—Delbert E. Gantz
*Assistant Examiner*—Glenn A. Caldarola
*Attorney, Agent, or Firm*—A. J. McKillop; M. G. Gilman; J. F. Powers, Jr.

[57] ABSTRACT

This invention provides a process for upgrading heavy hydrocarbon oil by thermal treatment which in one preferred embodiment involves heating a petroleum residuum type of heavy oil feedstock at a temperature of 450°-550° C. and a pressure of 10-200 psi for a period of about 0.1-1 hour to convert at least 60 weight percent of the heavy oil to gasoline and gas oil range products, and additionally providing a residual tar fraction which has a fusion temperature below about 160° C.

About 1-10 weight percent of solid carbonaceous fines are incorporated in the feedstock to suppress the deposition of coke in the thermal treatment zone.

13 Claims, 3 Drawing Figures

Softening Point (fusion temp.) vs Residence Time

Softening Point (fusion temp.) vs Yield of Pitch (residue).

THERMAL TREATMENT OF HEAVY HYDROCARBON OIL

The present patent application is a continuation-in-part of patent application Ser. No. 281,159, filed July 8, 1981, now abandoned.

BACKGROUND OF THE INVENTION

Various hydrocarbon feedstocks such as crude petroleum oils, topped crudes, heavy vacuum gas oils, shale oils, tar sand bitumens, and other heavy hydrocarbon fractions such as residual fractions and distillates contain varying amounts of non-metallic and metallic impurities. The non-metallic impurities include nitrogen, sulfur, and oxygen and these exist in the form of various compounds and are often in relatively large quantities. The most common metallic impurities include iron, nickel, and vanadium. Other metallic impurities including copper, zinc, and sodium are often found in various hydrocarbon feedstocks and in widely varying amounts. Some of the metal contaminants are present in the form of relatively thermally stable organo-metallic complexes such as metal porphyrins.

Residual petroleum oil fractions produced by atmospheric or vacuum distillation of crude petroleum are characterized by relatively high metals and sulfur content. This occurs because substantially all of the metals present in the original crude remain in the residual fraction, and a disproportionate amount of sulfur in the original crude oil also remains in that fraction.

The high metals content of the residual fractions generally preclude their effective use as charge stocks for subsequent catalytic processing such as catalytic cracking and hydrocracking, because the metal contaminants deposit on the special catalysts for these processes and cause the formation of inordinate amounts of coke, dry gas and hydrogen.

It is current practice to upgrade certain residual fractions by a pyrolytic operation known as coking. In this operation the residuum is destructively distilled to produce distillates of low metals content and leave behind a solid coke fraction that contains most of the metals. Coking is typically carried out in a reactor or drum operated at about 800°-1100° F. (426°-593° C.) temperature and a pressure of 1-10 atmospheres. The economic value of the coke byproduct is determined by its quality, particularly its sulfur and metals content. Excessively high levels of these contaminants makes the coke useful only as low-valued fuel. In contrast, cokes of low metals content, for example up to about 100 ppm (parts per million by weight) of nickel and vanadium, and containing less than about 2 weight percent sulfur may be used in high-valued metallurgical, electrical, and mechanical applications.

Certain residual fractions are currently subjected to visbreaking, which is a heat treatment of milder conditions than used in coking, in order to reduce their viscosity and make them more suitable as fuels. It usually involves a short soak time at a temperature of about 800°-950° F. (443°-510° C.) The mild thermal cracking conditions of visbreaking produces about 5-15 percent of gas oil, about 5-15 percent of gasoline, and about 70-85 percent of heavy fuel oil. Typical visbreaking procedures are described in U.S. Pat. Nos. 2,358,573 and 2,695,264, and in 1980 Refining Process Handbook, page 158 (Reprinted from September 1980 issue of Hydrocarbon Processing, Gulf Publishing Co., Houston, Texas).

Visbreaking does not significantly reduce the metals content of the visbroken distillate fractions. For example, the gas oil from the visbroken effluent contains at least about 1-25 ppm of nickel and vanadium.

The economic and environmental factors relating to upgrading of petroleum residual oils and other heavy hydrocarbon feedstocks have encouraged efforts to provide improved processing technology, as exemplified by the disclosures of various United States patents such as U.S. Pat. Nos. 2,591,525; 2,717,865; 2,761,816; 2,909,476; 2,921,022; 2,950,231; 2,987,470; 3,094,480, 3,146,188; 3,594,312; 3,663,434; 3,676,369; 3,696,027; 3,716,479; 3,766,054; 3,772,185; 3,775,303; 3,813,331; 3,839,187; 3,847,798; 3,876,530; 3,882,049; 3,897,329; 3,901,792; 4,062,757; and the like, and references cited therein.

There is continuing research effort to improve the efficiency of processing means for upgrading of hydrocarbon feedstocks, with particular reference to petroleum residual oils.

Accordingly, it is an object of this invention to provide an improved process for converting heavy hydrocarbon oils into effluent fractions having a substantially reduced content of sulfur, metal and nitrogen contaminants.

It is another object of this invention to provide a process for converting heavy hydrocarbon feedstocks by thermal treatment into liquid hydrocarbon fractions which boil in the gasoline range and in the gas oil range between about 400°-900° F. (204°-482° C.), substantially without the formation of coke.

It is a further object of this invention to provide a process for upgrading heavy hydrocarbon oils into gasoline and gas oil fractions, and into a residual tar fraction which has a fusion temperature below about 160° C.

Other objects and advantages of the present invention shall become apparent from the accompanying description and illustrated Example.

DESCRIPTION OF THE INVENTION

Figure 1:
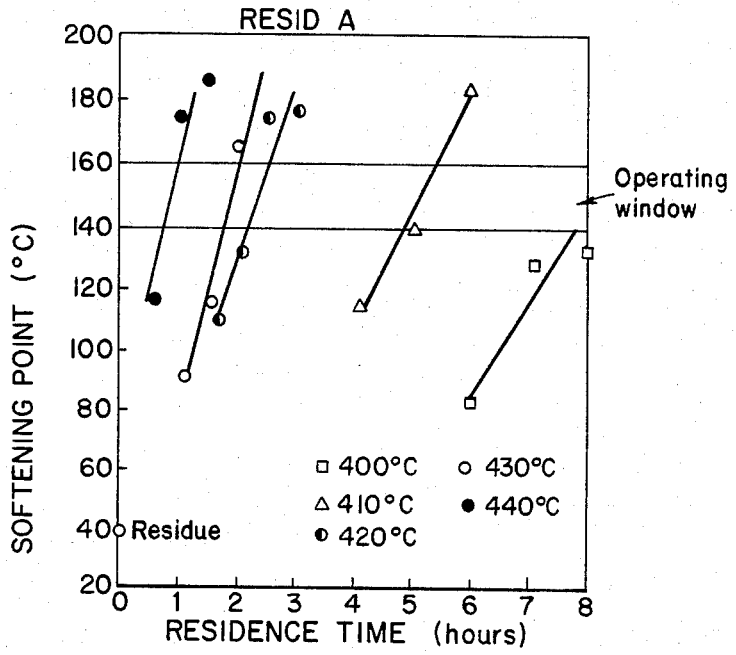
FIG. 1 illustrates the relationship between softening point (°C.) versus residence time (hours) for different resids.
Figure 1:
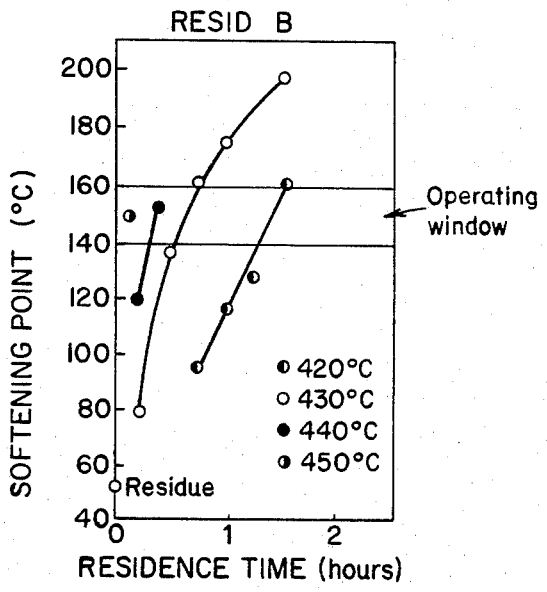

One or more objects of the present invention are accomplished by the provision of a process for upgrading heavy hydrocarbon oil by thermal treatment which comprises (1) heating heavy hydrocarbon oil at a temperature between about 800°-1000° F. (425°-550° C.) and a pressure between about 100-2000 psi for a soak period between about 0.05-2 hours at the highest Severity sufficient to convert at least about 50 weight percent of the heavy hydrocarbon oil to gasoline and gas oil range hydrocarbons, substantially without the formation of solid coke; and (2) recovering separate fractions of gasoline and gas oil, and residual tar which has a fusion temperature below about 320° F. (160° C.) and a guinoline-insoluble content between about 20-50 weight percent.

The weight percent yields of conversion products under optimal conditions typically are in the ranges between about 1-5 percent of gas, 20-30 percent of gasoline, 30-40 percent of gas oil (200°-550° C.), 20-35 percent of residual tar having a fusion temperature below about 160° C., and less than about 2 percent of solid coke, based on the weight of heavy hydrocarbon oil.

An important aspect of the present invention process is the achievement of an optimal yield of gasoline and gas oil without the formation of solid coke, and concomitantly the provision of a residual tar which is pumpable at a temperature above about 160° C.

The term "heavy hydrocarbon oil" is meant to include petroleum oil residua and tar sand bitumen feedstocks, in which at least 75 weight percent of the constituents have a boiling point above about 700° F. (370° C.).

Typically, a heavy hydrocarbon oil suitable for treatment in accordance with the present invention has a metals content of at least 80 ppm, and a Conradson Carbon Residue content of at least 10 weight percent.

The Severity of thermal treatment conditions can be expressed in terms of Severity(S), which is equal to Soaking Factor multiplied by reaction time. The parameters are reaction temperature and reaction time.

Severity is conveniently expressed in terms of "equivalent reaction time in seconds" (ERT), as measured at 800° F.

The expressions "Severity"(S) and "Soaking Factor"(SF) as employed herein refers to the following algorithmic relationship of thermal treatment parameters:

$$\text{Severity(S)} = \text{Soaking Factor}(SF_{800}) \times \text{Residence Time}(\theta)$$

Since the coil temperature is not uniform, the average Soaking Factor(SF) for the whole coil reactor is obtained as follows:

$$SF_{800} = \int_{800}^{T_f} \left(\frac{k_T}{k_{800}}\right) dV$$

In order to express Severity(S) in terms of ERT as measured at 800° F., the SF relative to that at 800° F. has to be employed.

To integrate the above equation, the coil temperature profile relating to the reactor volume V (indirectly through distance L) has to be determined experimentally or calculated, which can be expressed mathematically as follows:

$$T = f(L) = F(V)$$

By differentiation, we obtain:

$$dT = F'(V)dV \quad dV = 1/F'(V)dT$$

Therefore, $SF_{800}$ becomes:

$$SF_{800} = \int_{800}^{T_f} \left(\frac{k_T}{k_{800}}\right) \frac{dT}{F'(V)}$$

and the equation can be integrated either analytically or graphically to obtain $SF_{800}$.

Where:

T, $T_f$ = coil temperatures at any position and the outlet, respectively, °F.

$SF_{800}$ = soaking factor relative to that at 800° F. base temp.

($k_T/k_{800}$ = ratio of reaction rate constants at T and 800° F.

dV = differential coil volume, $ft^3$/bbl/day.

$\theta$ = residence time, seconds.

L = distance from the inlet, ft.

Note that $S = SF_{800} \times \theta$ (the first equation above). That is, Severity is proportional to residence time ($\theta$); that is why the Severity is often expressed in terms of $\theta$, i.e., equivalent reaction time at 800° F.

Typically the highest Severity conditions in the thermal treatment zone will be in the range between about 700-2000 seconds, as expressed in equivalent reaction time at 800° F.

As the Severity level in a thermal treatment zone increases, the yield of gasoline and gas oil conversion products increases, and the fusion temperature (ASTM D 3104-77 or ASTM D 2319-76) and the quinoline-insoluble content of the residual tar product increases. For each heavy oil feedstock there is a highest Severity level which achieves the desired balance of gasoline and gas oil yield relative to the yield of residual tar product which has a fusion temperature below about 160° C. and a guinoline-insoluble content between about 20-50 weight percent, essentially without any formation of coke byproduct.

In addition to Severity, the yield and quinoline-insoluble content of the residual tar product are quantities which are functionally related to the asphaltene content of the starting heavy oil feedstock. As demonstrated by the data in the Example, nominally the asphaltene content of the heavy hydrocarbon oil relates to the residual tar yield and residual tar quinoline-insoluble content in accordance with the following equation:

$$\text{wt \% asphaltenes} \cdot \frac{\text{wt \% tar quinoline} - \text{insolubles}}{\text{wt \% tar yield}} = 6\text{-}12$$

The quinoline-insoluble content of the tar product can be determined by means of ASTM D 2318-76.

The operating range for the invention process is narrow and specific to each feedstock (e.g., Khafji and Minas resids). As shown in FIG. 1, for each temperature the variation in residence time to obtain bottom residue with ±10° C. softening point is narrow. Similarly, for each residence time, the operable temperature is very narrow. The nature of resids is critical in deciding this operable condition due to their differences in reactivity. In FIG. 1, the nominal profiles indicate that Resid B is much more reactive than Resid A. This is illustrated in the Table on page 16 of the specification where the Khafji resid is much more reactive than the Minas resid, but the operating window for each resid is very narrow within the overall operation range encompassing all kinds of residua.

Figure 2:
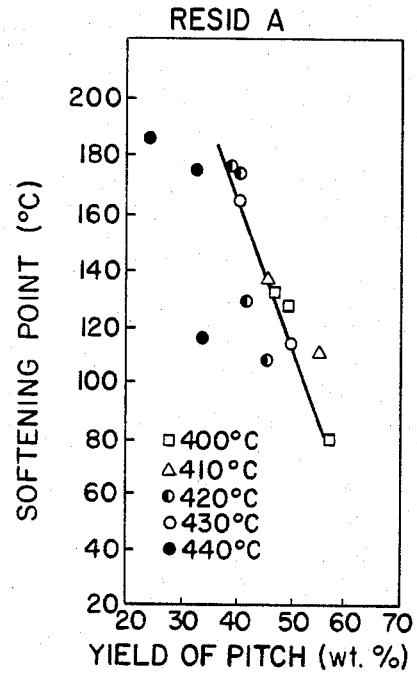
FIG. 2 illustrates the relationship between softening point (°C.) versus pitch yield for different resids.
Figure 2:
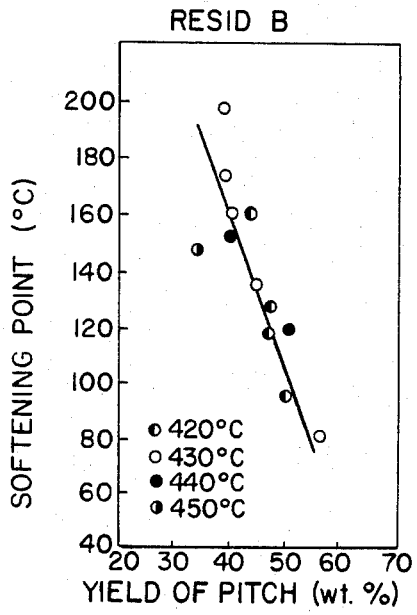

Further, there is a unique relationship between the softening point (fusion temperature) of the residual tar (pitch) and its yield. As shown by the data in FIG. 2, this relationship is largely independent of feedstock and operating conditions. Thus, by monitoring the yield of residual tar the operating conditions can be adjusted to control the quality of the desired product. It has been found that a residual tar of about 150° C. fusion temperature can be satisfactorily used in conventional furnaces with minor modifications.

In another embodiment, this invention provides a process for upgrading heavy hydrocarbon oil by thermal treatment which comprises (1) heating heavy hydrocarbon oil at a temperature between about 425°–550° C. and a pressure between about 100–2000 psi for a soak period between about 0.05–2 hours at the highest Severity sufficient to convert at least about 50 weight percent of the heavy hydrocarbon oil to gasoline and gas oil range hydrocarbons, substantially without the formation of solid coke; (2) recovering separate fractions of gasoline and gas oil, and residual tar which has a fusion temperature below about 160° C. and a guinoline-insoluble content between about 20–50 weight percent; and (3) feeding the residual tar in the form of liquid fuel to a furnace.

In another embodiment, the residual tar which is recovered in step(2) is pumped in liquid form (e.g., at a temperature of 200° C.) to a gasification system for the production of synthesis gas.

In a further embodiment, a portion of the residual tar which is recovered in step (2) is recycled in liquid form to step(1) of the process. The residual tar contains colloidal solids which function to suppress coke deposition on the heater surfaces during the step(1) thermal conversion of the heavy hydrocarbon oil feedstock.

In a typical run, the pressure in the step(1) heating zone reactor is in the range between about 200–1000 psi, and the system is operated continuously at a liquid hourly space velocity in the range between about 1–10.

In still another embodiment, this invention contemplates a process for upgrading heavy hydrocarbon oil by thermal treatment which comprises (1) heating heavy hydrocarbon oil at a temperature between about 450°–550° C. and a pressure between about 10–200 psi for a soak period between about 0.1–1 hour sufficient to convert at least 50 weight percent of the heavy hydrocarbon oil to gasoline and gas oil range hydrocarbons, substantially without the formation of solid coke; (2) and recovering separate fractions of gasoline and gas oil, and residual tar which has a fusion temperature below about 160° C. and a quinoline-insoluble content between about 20–50 weight percent.

In one preferred method of practicing the present invention process, an inert gas (e.g., steam, nitrogen or gaseous hydrocarbon) is introduced into the step(1) heating zone reactor at a partial pressure of about 10–200 psi and at a temperature of about 535° C. The corresponding partial pressure of the hydrocarbon vapor phase is less than about 10 psi, and the average temperature in the heating zone reactor is about 450°–525° C. The system is operated continuously, and the average residence time of the hydrocarbon oil in the heating zone is about 0.2–0.5 hour (e.g., a LHSV of about 2–5).

To prevent the deposition of coke on the walls of the heating coils and reactor, it is advantageous to admix between about 1–10 weight percent of finely divided solids in the heavy hydrocarbon oil feedstream. The preferred solids are carbonaceous fines derived from coke, coal, sawdust, and the like, which have an average particle size in the range between about 50–400 mesh.

Any coke that forms during the soak period deposits on the particles that are present and results in coked particles of relatively uniform size and shape, which particles do not settle out and which simultaneously serve as a scouring agent to cleanse any loose coke deposits from the walls of the equipment. As noted previously, the residual tar fraction containing coke fines and colloidal solids may also be recycled for the same purpose of suppressing coke deposition.

A unique aspect of the invention process is the recovery of a residual bottoms fraction which is in the form of a tar which has a fusion temperature below about 160° C. Hence, at a temperature above about 160° C.,the recovered residual tar fraction is in the form of a pumpable liquid stream.

The said residual tar can be pumped as liquid fuel to the furnace in the processing system, or to any other furnace or heat exchanger in a proximate operation. The stack gas sulfur oxides from the tar combustion can be recovered for the production of elemental sulfur.

Illustrative of the invention process, the drawing is a schematic representation of thermal treatment and steam distillation units in series for processing of heavy hydrocarbon oil, with recovery of products and residual tar fractions.

The heavy hydrocarbon oil is an Arabian light vacuum residual fraction which has the following analysis:

| | |
|---|---|
| API, gravity | 8.3 |
| H, wt% | 10.67 |
| S, wt% | 3.93 |
| N, wt% | 0.28 |
| CCR, wt% | 16.13 |
| V, ppm | 68 |
| Ni, ppm | 17 |
| MW | 810 |

Figure 3:
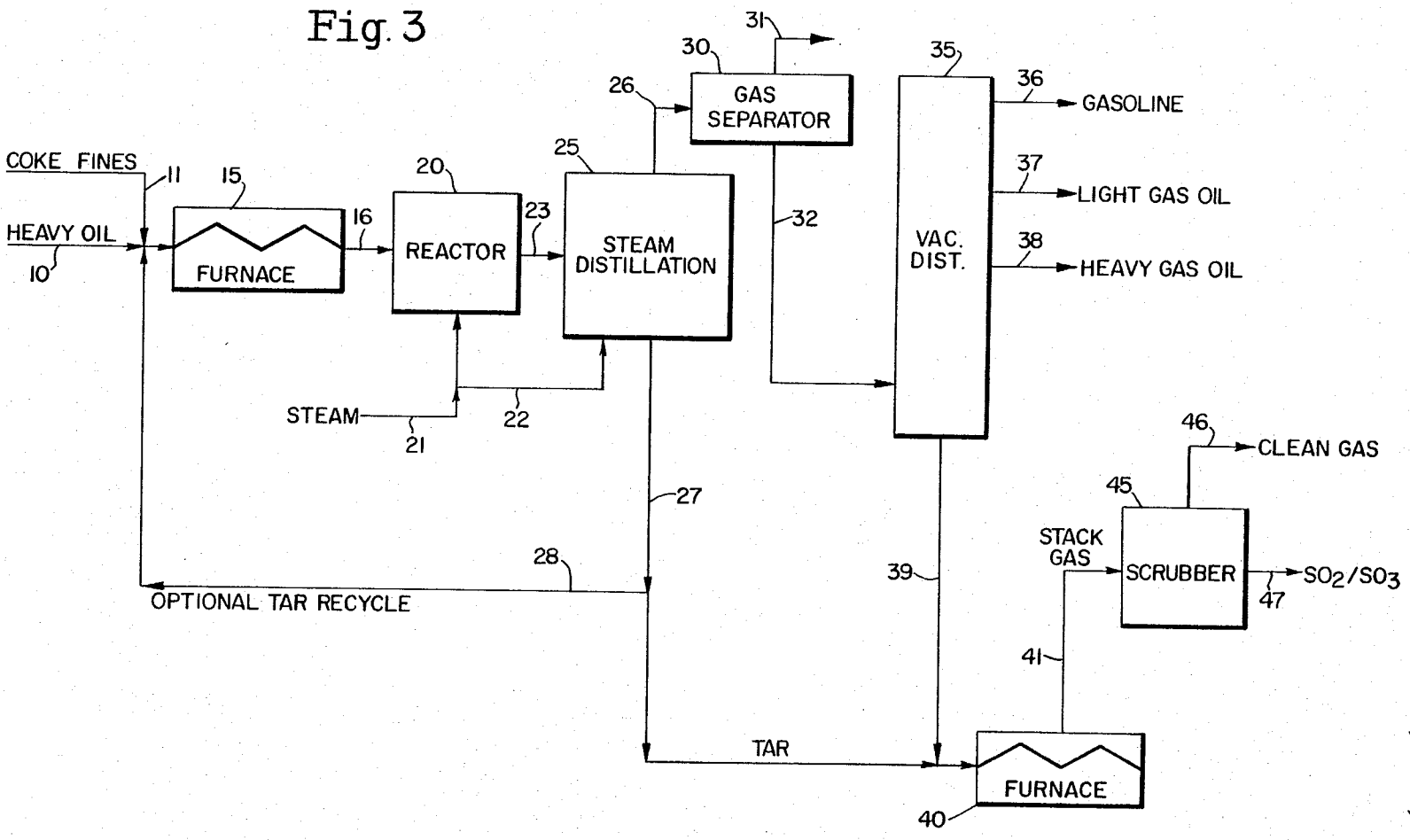
FIG 3 depicts the overall thermal treating process of the present invention.

Referring to FIG. 3, heavy hydrocarbon oil in line 10 is slurried with coke fines (50–200 mesh) from line 11 (about 2 weight percent based on the weight of hydrocarbon oil) and charged to Furnace 15. The heated slurry passes continuously through line 16 into Reactor 20 which functions as a soak tank for the thermal conversion of the heavy hydrocarbon oil.

Reactor 20 is pressurized with superheated steam (about 535° C.) through line 21 to a steam partial pressure level of about 150 psi. The resultant temperature in Reactor 20 is about 490° C., and the partial pressure of the hydrocarbon vapor phase is about 30 psi. The average residence time of the hydrocarbon oil in Reactor 20 is about 15 minutes.

Visbroken effluent is passed from Reactor 20 via line 23 into Steam Distillation unit 25. Superheated steam as required is supplied through line 22 to Steam Distillation unit 25. The steam distillation procedure strips the visbroken constituents which have a boiling point below about 1000° F. (537° C.), and the stripped constituents are recovered overhead through line 26 for transfer to Gas Separator 30. A residual tar fraction is withdrawn from Steam Distillation 25 by means of line 27. A portion of the residual tar fraction optionally is recycled through line 28 to Furnace 15, in place of or in addition to the coke fines being supplied through line 11. The incorporation of carbonaceous fines into the heavy hydrocarbon oil feedstock suppresses the deposition of coke in Furnace 15 and Reactor 20 and the connecting lines.

In Gas Separator 30, a gasiform stream is recovered through line 31, and the main liquid product stream is withdrawn through line 32 and charged to Vacuum Distillation unit 35.

The vacuum distillation of the product mixture yields fractions which include gasoline, light gas oil, heavy gas oil and a residual tar bottoms which are isolated via lines 36 through 39, respectively.

The residual tar fractions recovered through lines 27 and 39 are pumpable liquids at a temperature of 180° C. A portion of the residual tar is fed as liquid fuel to furnace 40. The overhead stack gas is transferred via line 41 to Sulfur Dioxide Scrubber 45 which contains a scrubbing medium of activated charcoal. A clean gas stream is vented through line 46.

A concentrated stream of $SO_2/SO_3$ is recovered from Scrubber 45 through line 47 and transferred as feed to a Claus plant. The $SO_2/SO_3$ feed is reacted with hydrogen sulfide to produce elemental sulfur.

The following Example is further illustrative of the present invention. The specific ingredients and processing parameters are presented as being typical, and various modifications can be derived in view of the foregoing disclosure within the scope of the invention.

EXAMPLE

This Example illustrates the thermal conversion of heavy hydrocarbon oils in accordance with the present invention.

The reactor is a stainless steel tube ($\frac{3}{8}$" ID×16"). The reactor temperature is controlled with a four zone furnace to obtain a uniform temperature. The reactor pressure is controlled by use of a back pressure controller.

The reactor is first pressurized to the reaction pressure with nitrogen. The residuum feed is then pumped through the reactor at the desired rate using a positive pump to assure accurate flow rate and residence time. The product is separated into gas and liquid with a high pressure separator, and the gaseous product is measured and analyzed.

The liquid product is vacuum distilled to obtain a residual tar. The end point of the distillation is adjusted so that the melting point of the tar is lower than 160° C. Typically the distillation end point is about 540° C. (at atmospheric pressure).

The residual properties, reaction conditions, product yield and residual tar properties are listed in the Table.

Substantially all of the sulfur, metal and nitrogen contaminants of the original heavy hydrocarbon oil are concentrated in the residual tar fraction. The gas oil distillate which is recovered is suitable as feedstock for a conventional fluidized catalytic cracker unit.

TABLE

| | MINAS | KHAFJI |
|---|---|---|
| Residua Properties | | |
| Specific gravity, 15/4° C. | 0.937 | 1.032 |
| CCR, wt % | 10.4 | 20.9 |
| Asphaltenes, wt % | 5.1 | 16.8 |
| Pour point, °C. | 47.5 | 62.5 |
| Sulfur, wt % | 0.2 | 5.43 |
| Ni, ppm | 37.2 | 52.0 |
| V, ppm | 0.9 | 154 |
| Reaction Conditions | | |
| Reaction Temp., °C. | 465 | 465 |
| Reaction Press., psi | 200 | 200 |
| Reaction Time, min. | 110 | 60 |
| Product Yield, wt % | | |
| Gas | 4.0 | 6.0 |
| Oil | 66.0 | 51.0 |
| Residual Tar | 30.0 | 43.0 |
| Tar Properties | | |
| Volatile Matter, wt % | 42 | 44 |
| Quinoline-insoluble, wt % | 50 | 23 |
| Fusion Temp., °C. | 150 | 150 |

What is claimed is:

1. A process for upgrading heavy hydrocarbon oil by thermal treatment which comprises (1) heating heavy hydrocarbon oil at a temperature between about 425°-550° C. and a pressure between about 100-2000 psi for a soak period between about 0.05-2 hours at the highest Severity in the range between about 700-2000 seconds, as expressed in equivalent reaction time at 800° F., sufficient to convert at least about 50 weight percent of the heavy hydrocarbon oil to gasoline and gas oil range hydrocarbons, substantially without the formation of solid coke; and (2) recovering separate fractions of gasoline and gas oil, and residual tar which has a fusion temperature below about 160° C. and a quinoline-insoluble content between about 20-50 weight percent; wherein the highest Severity in step(1) is determined by a functional relationship between the asphaltene content of the heavy hydrocarbon oil and the residual tar yield and residual tar quinoline-insoluble content in accordance with the following equation:

$$\text{wt \% asphaltenes} \cdot \frac{\text{wt \% tar quinoline} - \text{insolubles}}{\text{wt \% tar yield}} = 6\text{–}12$$

2. A process in accordance with claim 1 wherein the heavy hydrocarbon oil feedstock in step(1) has a boiling range above about 500° C.

3. A process in accordance with claim 1 wherein the heavy hydrocarbon oil feedstock in step(1) has incorporated therein between about 1-10 weight percent of solid carbonaceous fines to suppress the deposition of coke during the soak period.

4. A process in accordance with claim 1 wherein the pressure in the reaction zone is in the range between about 200-1000 psi.

5. A process in accordance with claim 1 wherein the process is continuous and the liquid hourly space velocity is in the range between about 1-10.

6. A process in accordance with claim 1 wherein the highest Severity in the thermal treatment zone is in the range between about 700-2000 seconds, as expressed in equivalent reaction time at 800° F.

7. A process for upgrading heavy hydrocarbon oil by thermal treatment which comprises (1) heating heavy hydrocarbon oil at a temperature between about 425°-550° C. and a pressure between about 100-2000 psi for a soak period between about 0.05-2 hours at the highest Severity in the range between about 700-2000 seconds, as expressed in equivalent reaction time at 800° F., sufficient to convert at least about 50 weight percent of the heavy hydrocarbon oil to gasoline and gas oil range hydrocarbons, substantially without the formation of solid coke; (2) recovering separate fractions of gasoline and gas oil, and residual tar which has a fusion temperature below about 160° C. and a quinoline-insoluble content between 20-50 weight percent; and (3) feeding the residual tar in the form of liquid fuel to a furnace; wherein the highest Severity in step(1) is determined by a functional relationship between the asphaltene content of the heavy hydrocarbon oil and the residual tar yield and residual tar quinoline-insoluble content in accordance with the following equation:

$$\text{wt \% asphaltenes} \cdot \frac{\text{wt \% tar quinoline} - \text{insolubles}}{\text{wt \% tar yield}} = 6\text{–}12$$

8. A process in accordance with claim 7 wherein the furnace in step(3) is integrated with means to recover stack gas sulfur oxides for the production of elemental sulfur.

9. A process for upgrading heavy hydrocarbon oil by thermal treatment which comprises (1) heating heavy hydrocarbon oil at a temperature between about 425°-550° C. and a pressure between about 100-2000 psi for a soak period between about 0.05-2 hours at the highest Severity in the range between about 700-2000 seconds, as expressed in equivalent reaction time at 800° F., sufficient to convert at least about 50 weight percent of the heavy hydrocarbon oil to gasoline and gas oil range hydrocarbons, substantially without the formation of solid coke; (2) recovering separate fractions of gasoline and gas oil, and residual tar which has a fusion temperature below about 160° C. and a quinoline-insoluble content between about 20-50 weight percent; and (3) feeding the residual tar in liquid form to a gasification zone; wherein the highest Severity in step(1) is determined by a functional relationship between the asphaltene content of the heavy hydrocarbon oil and the residual tar yield and residual tar quinoline-insoluble content in accordance with the following equation:

$$\text{wt \% asphaltenes} \cdot \frac{\text{wt \% tar quinoline} - \text{insolubles}}{\text{wt \% tar yield}} = 6\text{-}12$$

10. A process for upgrading heavy hydrocarbon oil by thermal treatment which comprises (1) heating heavy hydrocarbon oil at a temperature between about 450°-550° C. and a pressure between about 10-200 psi for a soak period between about 0.1-1 hour at the highest Severity in the range between about 700-2000 seconds, as expressed in equivalent reaction time at 800° F., sufficient to convert at least 60 weight percent of the heavy hydrocarbon oil to gasoline and gas oil range hydrocarbons, substantially without the formation of solid coke; (2) and recovering separate fractions of gasoline and gas oil, and residual tar which has a fusion temperature below about 160° C. and a quinoline-insoluble content between about 20-50 weight percent; wherein the highest Severity in step (1) is determined by a functional relationship between the asphaltene content of the heavy hydrocarbon oil and the residual tar yield and residual tar quinoline-insoluble content in accordance with the following equation:

$$\text{wt \% asphaltenes} \cdot \frac{\text{wt \% tar quinoline} - \text{insolubles}}{\text{wt \% tar yield}} = 6\text{-}12$$

11. A process in accordance with claim 10 wherein the heavy hydrocarbon oil feedstock in step(1) has incorporated therein between about 1-10 weight percent of solid carbonaceous fines to suppress the deposition of coke during the soak period.

12. A process in accordance with claim 10 wherein the heating zone in step(1) is initially pressurized with an inert gas, and the partial pressure of hydrocarbon vapor in the said heating zone is less than about 50 psi.

13. A process in accordance with claim 12 wherein the inert gas in the heating zone is superheated steam.

* * * * *